US006290098B1

(12) United States Patent
Sterner et al.

(10) Patent No.: US 6,290,098 B1
(45) Date of Patent: Sep. 18, 2001

(54) FLOW PROMOTION APPARATUS

(75) Inventors: Keith Sterner, Bath; James L. Marino, Bethlehem; John F. Simonof, Easton, all of PA (US); David R. Gill, Stewartsville, NJ (US)

(73) Assignee: Flexicon Corporation, Phillipsburg, NJ (US)

( * ) Notice: Subject to any disclaimer, the term of this patent is extended or adjusted under 35 U.S.C. 154(b) by 0 days.

(21) Appl. No.: 09/545,426

(22) Filed: Apr. 7, 2000

(51) Int. Cl.[7] ..... B65D 35/56
(52) U.S. Cl. ..... 222/105; 222/181.2
(58) Field of Search ..... 222/105, 181.2, 222/196, 200, 202, 203

(56) References Cited

U.S. PATENT DOCUMENTS 2,858,051 * 10/1958 Cunningham ..... 222/105
4,303,011 * 10/1958 Reiner ..... 222/105
4,527,716 * 7/1985 Haas et al. ..... 222/181.2
5,699,730 * 12/1997 Ogier et al. ..... 222/105

* cited by examiner

*Primary Examiner*—Philippe Derakshani
*Assistant Examiner*—Thach H Bui
(74) *Attorney, Agent, or Firm*—Volpe & Koenig, PC

(57) ABSTRACT

A flow promotion apparatus for use in conjunction with a bulk bag unloading station. The apparatus comprises a pair of spaced apart mounting brackets, a fluid actuator, a connecting rod and a push bar. The fluid actuator is pivotably connected at one end to one of the mounting brackets. The connecting rod is pivotably connected at one end to the other mounting bracket and pivotably connected at its other end to the piston. The push bar is pivotably coupled at the junction between the fluid actuator and connecting rod and actuation of the fluid actuator extends the push bar extends to agitate material along the side-walls of the bag.

12 Claims, 3 Drawing Sheets

FLOW PROMOTION APPARATUS

BACKGROUND

The present invention relates to the unloading of bulk bags used as containers for dry or moist particulate materials. The present invention more particularly relates to the unloading of bulk bag containers fabricated from cloth like material, such as woven polyester material, which is usually sewn in a cubical configuration.

Bulk bags 2 made of heavy cloth material have been known in the art for sometime. It has also been known to provide the bag with heavy corner straps 4 which support the bag 2 when it is hung in a tower like support frame 6. The opposite end of the bag 2 typically has a central outlet spout 5 which is aligned with a discharge unit 10, for example a conveyer, hopper or the like, into which the material in the bag 2 is intended to be discharged.

To discharge the bag 2, the bag 2 is hung in the support frame 6 and the spout 5 engaged with the discharge unit 10. The spout 5 is opened and the particulate material flows via gravity through the spout 5. It is a characteristic of some particulate materials contained in a bag to resist or stop flowing out of the spout 5 when the material remaining in the bag 2 reaches the material's angle of repose or bridges over the spout 5. Since the bottom of the bag 2, extending from the spout 5 to the walls, is typically not at angle greater than the material's angle of repose, not all of the material will be discharged through the spout 5 by gravity. The material remaining in the bag 2 after the discharge by gravity often forms a cone shape inside the container. The inner face of this cone shape, formed by the granular material, extends from the spout 5 in the bottom of the bag 2 upward at an angle to the wall of the bag 2. The angle of repose at which this cone shape occurs and discharge by gravity ends depends on the physical characteristics of the bulk material involved.

To promote flow and reduce the likelihood of stacking of material along the walls, it is known in the art to use rotatable plate assemblies 12 adjacent the bottom of the bag 2. The rotatable plates rotate from a substantially horizontal position to an inclined position to push the bottom corners of the bag 2 inward to promote flow towards the central spout 5. While the rotatable plate assemblies 12 have proven successful in helping promote flow, some materials having a high angle of repose and resistance to flowing freely still tend to stack along the walls of the bag 2.

Accordingly, there is a need for an apparatus which promotes flow of the material stacking along the walls of the bag.

SUMMARY

The present invention provides a flow promotion apparatus for use in conjunction with a bulk bag unloading station. The apparatus comprises a pair of spaced apart mounting brackets secured to the unloading station. A fluid actuator is pivotably connected at one end to one of the mounting brackets and has an extendable piston at its other end. A connecting rod is pivotably connected at one end to the other mounting bracket and pivotably connected at its other end to the piston. A push bar having an apertured flange between its ends is pivotably coupled at the junction between the fluid actuator and connecting rod. Upon actuation of the fluid actuator, the push bar extends along an arcuate path toward the bulk bag to agitate material along the side walls of the bag.

BRIEF DESCRIPTION OF THE DRAWING(S)

DETAILED DESCRIPTION OF THE PREFERRED EMBODIMENT(S)

Figure 1:
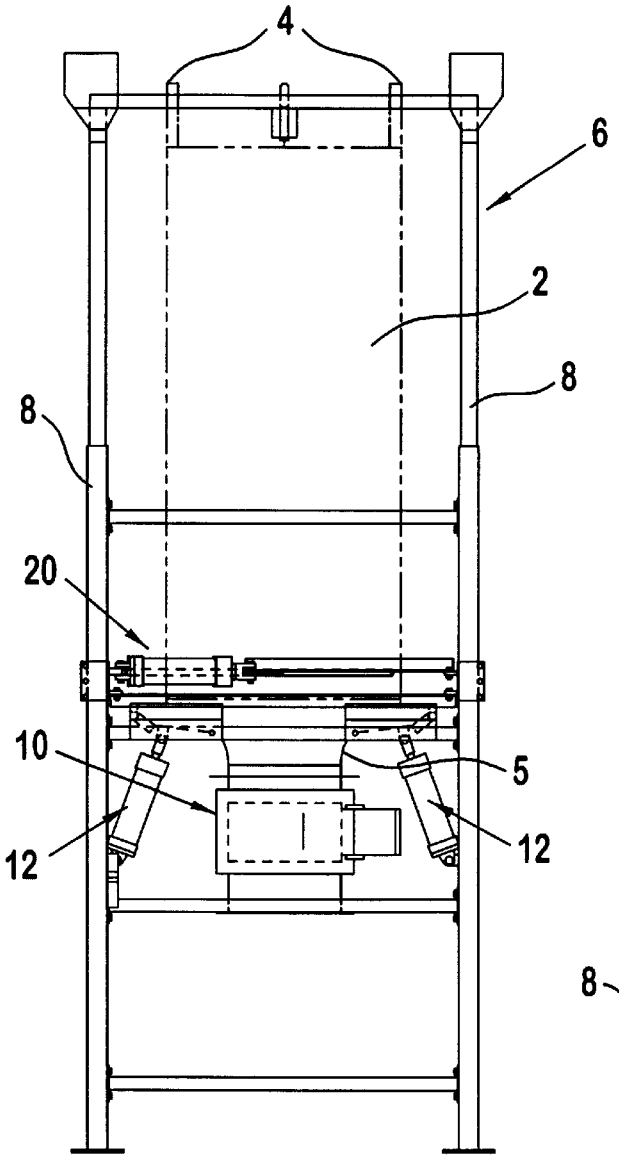
FIGS. 1 and 2 are front and side elevational views of a bulk bag unloading station incorporating the present invention.
Figure 2:
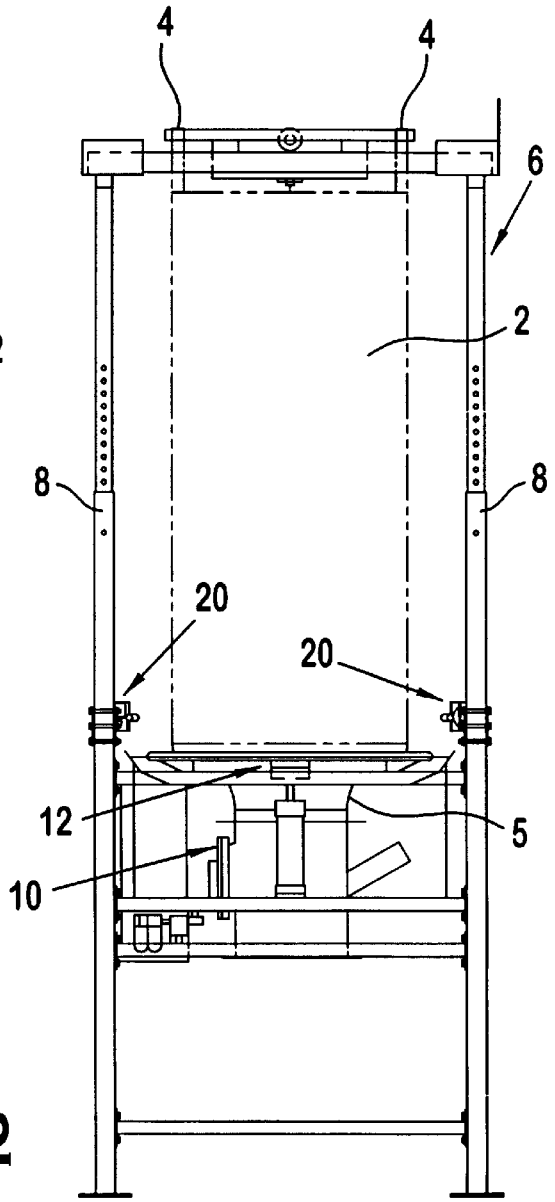

The preferred embodiment of the present invention will be described with reference to the drawing figures where like numerals represent like elements throughout.

Figure 3:
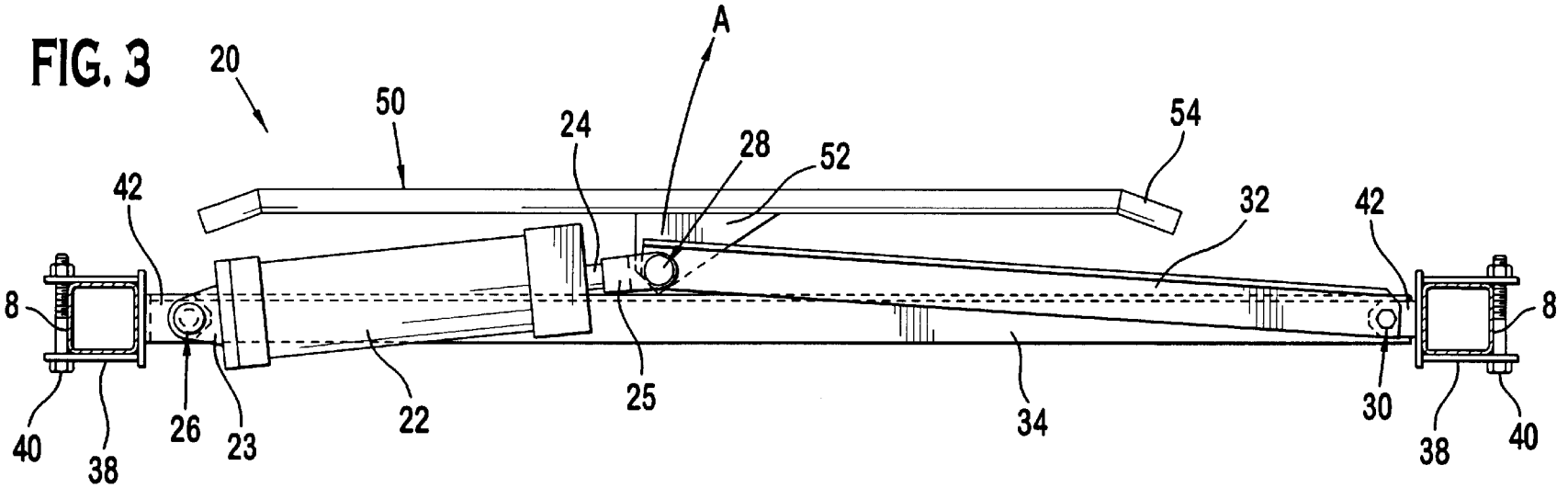
FIG. 3 is a top plan view of the flow promotion apparatus of the present invention.
Figure 4:
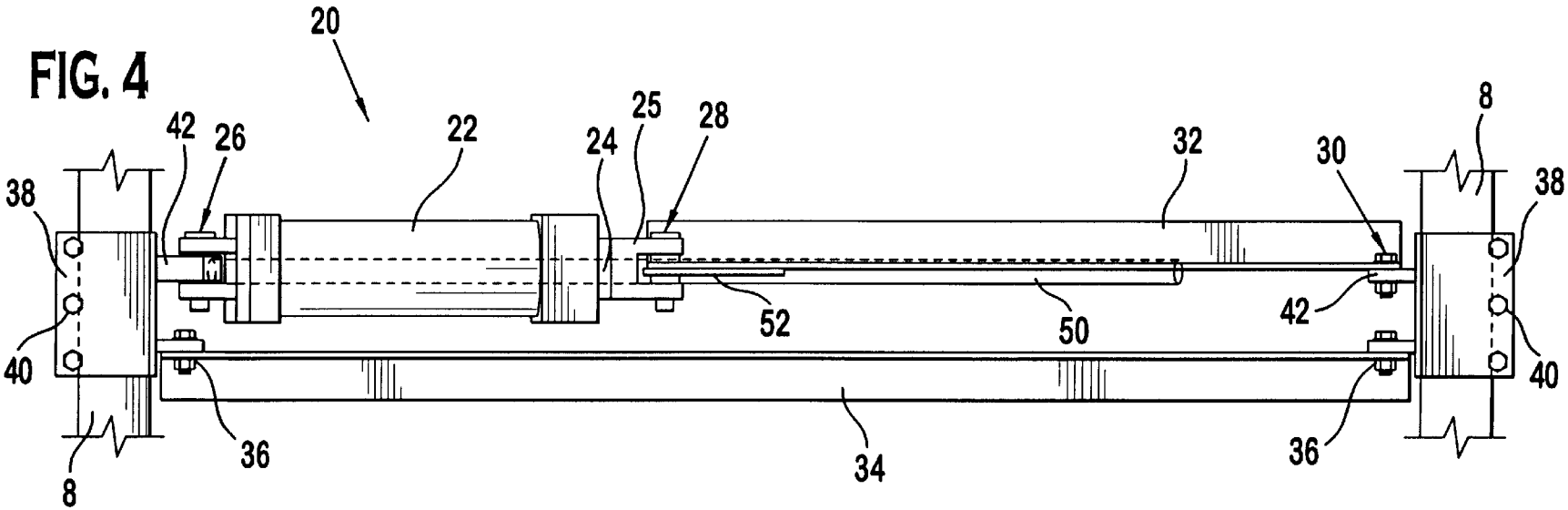
FIG. 4 is a side elevation view of the flow promotion apparatus of the present invention.

Referring to FIGS. 3 and 4, the preferred embodiment of the flow promotion apparatus 20 will be described. The flow promotion apparatus 20 generally includes a pair of mounting brackets 38, a fluid actuator 22, a connecting rod 32, and a push bar 50. Each mounting bracket 38 is configured to engage a respective support frame post 8. The mounting brackets 38 preferably have fasteners 40 which allow the brackets 38 to be tightened and secured once they have been positioned at a desired height along the respective posts 8. Referring to FIG. 1, the flow promotion apparatuses 20 are preferably positioned slightly above the height of the rotatable plate assemblies 12. Additionally, the flow promotion apparatuses 20 are preferably positioned between the posts 8 which are opposite that of the rotatable plate assemblies 12, i.e. such that apparatuses 20 longitudinal dimension is perpendicular to the longitudinal dimension of the rotatable plates.

Each mounting bracket 38 has an internally extending apertured flange 42. One end of the fluid actuator 22 includes an apertured flange 23 which is aligned with and pivotably interconnected with one of the mounting bracket flanges 42 via pivot pin 26. A piston 24 extends from the other end of the fluid actuator 22 and terminates at an apertured coupling bracket 25. The piston 24 is extendable from the fluid actuator 22 by activation of a fluid supply (not shown), preferably a pneumatic air line.

A connecting rod 32 is pivotably connected at one end to the other mounting bracket flange 42 via a pivot pin 30. The opposite end of the connecting rod 32 is pivotably connected to the coupling bracket 25 at pivot junction 28. The fluid actuator 22 and connecting rod 32 are dimensioned such that when the two are coupled, with the piston 24 in its non-extended state, the pivot junction 28 is not on-center with a line extending between the two frame posts 8, but rather slightly inward therefrom. As such, when the piston 24 is activated, it will cause the pivot junction 28 to rotate along an inward, arcuate path as represented by arrow A in FIG. 3. Since the fluid actuator 22 is pivotably mounted, it rotates as the piston 24 is extended. In this manner, the longitudinal axis of the piston 24 continues to pass through the pivot junction 28 through its entire stroke. A tie rod 34 may be extend between rigid connections 36 on the mounting brackets 38 to provide additional stability to the apparatus 20.

The push bar 50 is preferably a one inch diameter steel rod having a length approximately three-quarters the distance between the support frame posts 8. Both ends 54 of the push rod 50 are preferably beveled away from the leading edge to reduce the likelihood that the bar 50 will snag the bag 2 as it moves against and along the bag 2. An apertured flange 52 extends from the trailing edge of the push bar 50. The flange 52 aligns with and is secured at the pivot junction 28 of the fluid actuator 22 and connecting rod 32. As such, upon activation of the piston 24, the push bar 50 moves along the inward arcuate path A. Additionally, the pivot junction 28 allows the push bar 50 rotational flexibility such that it automatically aligns with the contours of the bag 2 as it contacts such.

Figure 5:
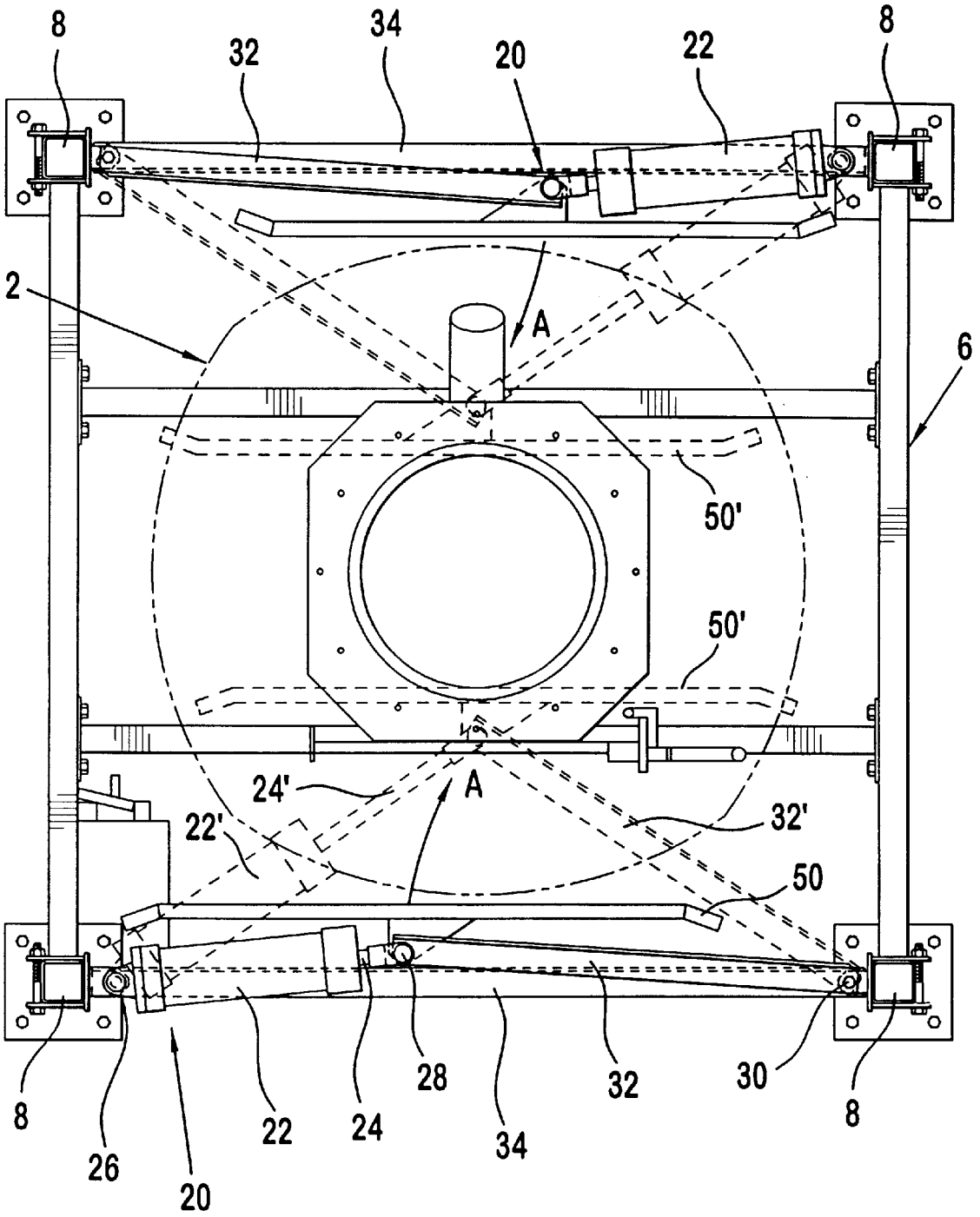
FIG. 5 is a top plan view of a portion of a bulk bag unloading station incorporating the present invention.

Having described the components of the flow promotion apparatus 20, its operation will now be described with reference to FIG. 5. It is preferable to have a pair of opposed flow promotion apparatuses 20, but more or fewer devices can be used. Each apparatus 20 is secured along the frame post 8 at a desired height. The opposed apparatuses 20 are sufficiently spaced such that a full bag 2 can be hung in a normal manner in the support frame 6. Once hung, the bag 2 is opened and allowed to empty in a conventional manner. A fluid control line (not shown) controls activation of the fluid actuators 22 to cause the push bars 50 to move along the inward arcuate path A to assert against the side walls of the bag 2. The force, duration, and sequencing of assertion of the push bars 50 against the bag 2 can be automated, or manually controlled, by controlling the amount of fluid to the fluid actuator 22.

Although it is preferable to actuate the opposed apparatuses 20 simultaneously, such is not required. Additionally, various actuation patterns can be utilized. For example, the actuators 22 may be cyclically provided with a given amount of pressure to provide a cyclic, predetermined force against the bag walls. Initially, the force will cause only a minor inward stroke of the push bar 50 due to the resistance of the substantially full bag. As the bag empties, the stroke of the push bar 50 will increase as the bag's resistence decreases. The apparatuses 20 preferably have a maximum stroke (as shown in phantom) in which the opposed push bars 50' are both approximately adjacent the opening of the spout 5. Alternatively, the force of the actuator 22 can be varied to coincide with the amount of material in the bag 2. In another pattern, the fluid source may be manually controlled whereby an operator selectively activates the piston 24 only when flow from the bag 2 begins to stagnate. These are only a few examplative control patterns. The apparatuses 20 can be controlled in any desired pattern depending on the given application.

What is claimed is:

1. A flow promotion apparatus for use in conjunction with a bulk bag unloading station, the apparatus comprising:

a pair of mounting brackets adapted for securement to the unloading station in spaced apart relation;

a fluid actuator, having first and second ends, pivotably connected at its first end to one of the mounting brackets and having a piston extendable from its second end;

a connecting rod, having first and second ends, pivotably connected at its first end to the other mounting bracket and pivotably connected at its second end to the piston at a pivot junction;

a push bar, having first and second ends and a pivot point therebetween, pivotably coupled at its pivot point to the pivot junction whereby upon actuation of the fluid actuator, the push bar is extended along an arcuate path to cause interference with a bulk bag positioned in the bulk bag unloading station.

2. The flow promotion apparatus of claim 1 wherein the piston has a longitudinal axis and the position of the axis relative to a center point of the pivot junction remains constant as the actuator is actuated.

3. The flow promotion apparatus of claim 2 wherein the axis extends through the center point.

4. The flow promotion apparatus of claim 1 wherein the push bar comprises a cylindrical bar having a leading edge and a trailing edge.

5. The flow promotion apparatus of claim 4 wherein each end of the push bar extends rearward at an acute angle relative to the leading edge.

6. The flow promotion apparatus of claim 4 the push bar further comprises a flange extending from the trailing edge and the pivot point is positioned on the flange.

7. The flow promotion apparatus of claim 1 wherein the push bar ends are equidistant from the pivot point.

8. The flow promotion apparatus of claim 1 wherein the push bar is pivotable about the pivot point.

9. The flow promotion apparatus of claim 1 wherein the mounting brackets are spaced at a given distance and the push bar has a length at least equal to half the given distance.

10. The flow promotion apparatus of claim 1 wherein the mounting brackets are spaced at a given distance and the push bar has a length at least equal to three-quarters the given distance.

11. The flow promotion apparatus of claim 1 wherein the fluid actuator is pneumatic.

12. The flow promotion apparatus of claim 1 wherein the fluid actuator is hydraulic.

* * * * *

UNITED STATES PATENT AND TRADEMARK OFFICE

CERTIFICATE OF CORRECTION

PATENT NO. : 6,290,098 B1
DATED : September 18, 2001
INVENTOR(S) : Sterner et al.

It is certified that error appears in the above-identified patent and that said Letters Patent is hereby corrected as shown below:

Title page,
Item [75], after "Keith" insert -- W. -- and after "Simonof" insert -- , Jr. --.

Signed and Sealed this

Thirtieth Day of April, 2002

*Attest:*

*Attesting Officer*

JAMES E. ROGAN
*Director of the United States Patent and Trademark Office*